United States Patent [19]

Uhlig

[11] Patent Number: 4,487,326

[45] Date of Patent: Dec. 11, 1984

[54] CARBONATED BEVERAGE PACKAGE

[75] Inventor: Albert R. Uhlig, Toledo, Ohio

[73] Assignee: Owens-Illinois, Inc., Toledo, Ohio

[21] Appl. No.: 550,349

[22] Filed: Nov. 10, 1983

[51] Int. Cl.[3] ..... B65D 51/16

[52] U.S. Cl. ..... 215/307; 215/320

[58] Field of Search ..... 215/250, 251, 307, 320; 220/306, 307, 366

[56] References Cited

U.S. PATENT DOCUMENTS

| | | | |
|---|---|---|---|
| 3,858,742 | 1/1975 | Grussen | 215/320 |
| 4,315,578 | 2/1982 | Ludwig, Jr. | 215/307 |
| 4,387,820 | 6/1983 | Ignell | 215/320 |

*Primary Examiner*—George T. Hall

*Attorney, Agent, or Firm*—John R. Nelson; Myron E. Click

[57] ABSTRACT

A carbonated beverage package comprising a container having an opening with a peripheral lip defining a free edge, and a downwardly and outwardly inclined sealing surface spaced from the free edge of the peripheral lip. A closure of plastic material, such that it will flex in thin cross section, is provided with an annular wall, a radial wall engaging the free edge of the peripheral lip of the container, and a transverse wall defining a convex surface facing inwardly of the container. The closure has a downwardly and outwardly inclined integral annular sealing surface at the juncture of the axial wall and transverse wall which engages the sealing surface of said container and places the axial wall under tension. The closure has a pressure relief rib at the juncture of the radial wall and axial wall such that axial force in the area overlying the rib will move a portion of the annular sealing surface of said closure away from the sealing surface of said container so that the pressure in the container can be relieved through a pressure relief opening through to the atmosphere and the closure can therafter be readily removed from the container.

35 Claims, 20 Drawing Figures

CARBONATED BEVERAGE PACKAGE

This invention relates to carbonated beverage packages.

BACKGROUND AND SUMMARY OF THE INVENTION

In the packaging of carbonated beverages, it has been common to fill the glass or plastic container and apply a closure such as a threaded closure or crown closure to seal the container.

One type of closure that has been utilized in connection with glass or plastic containers for carbonated beverages is a metal roll-on closure wherein the peripheral skirt of the closure is rolled to deform the skirt into conformity with the threads of the container. It has also been suggested that plastic closures having a top wall and a peripheral skirt with internal threads be utilized. In such plastic closures, the top wall seals with the open end or finish of the container. At low volumes of carbonation on the order of one or two volumes of carbonation, an adequate seal is provided. However, where the contents are at three or four volumes of carbonation, the carbonation pressure builds up against the top wall, deforms the top wall and reduces the effectiveness of the seal. This source of incipient leakage is further complicated by the manufacturing tolerances of the container, especially of the glass container. Attempts have been made to stiffen the top wall or otherwise prevent the deflection at the top wall with the consequent loss of the seal.

In both the metal and plastic containers, it has become necessary to add tamper indicating rings which are attached to the skirt of the closure and are torn or broken from the closure when the closure is removed.

As far as applicant is aware, no plastic closures have been successfully used in carbonated beverages which are of the snap-on type.

Another problem with respect to such constructions is that the high pressure of the contents sometimes causes a sudden surge of the contents out of the container when the closure is removed. It is therefore desirable to provide some type of pressure relief before the closure is removed.

In the packaging of liquids that are not carbonated, one type of container that is commonly used is of the flexible or bag type commonly known as a "bag in the box" type wherein a dispensing closure valve is attached to the bag for dispensing the contents such as milk or wine.

Such containers are utilized with dispensing closure valves, for example, such as shown in U.S. Pat. Nos. 3,400,866, 3,443,728, 3,972,452 and 4,211,348. These dispensing closure valves consist of a stem or spout attached to the container and a plastic snap-on closure which has a transverse wall in the form of a frustoconical peripheral portion and a flat transverse bottom portion. The peripheral portion seals against portions of the stem. When it is desired to dispense the contents, a tab on the flat portion is manipulated to flex the frustoconical wall portion out of engagement with the stem. In U.S. Pat. No. 3,400,866, an annular wall on the transverse wall engages an annular radially inwardly extending bead on the stem to provide the seal. However, internal pressure caused by gravity, dropping the package or by gases within the package will tend to force the seal apart. Similarly, U.S. Pat. No. 3,443,728 provides for a portion of the transverse wall to engage the free edge of the stem to provide the seal. Internal pressure will tend to move the transverse wall away from the sealing area. In U.S. Pat. No. 3,972,452, the transverse wall is formed with an annular sealing surface that engages the internal surface of the stem. However, the internal pressure on the transverse wall will tend to pull the cylindrical surface away from the surface of the stem. In U.S. Pat. No. 4,211,348, the transverse wall is formed with an annular bead that engages the cylindrical surface of the stem. Here again, internal pressure will move the annular bead away from the cylindrical surface.

The dispensing closure valves shown in the aforementioned patents cannot be used on containers where the contents are at high pressure.

Accordingly, among the objectives of the present invention are to provide a carbonated beverage package wherein the contents of the package are effectively maintained without the loss of pressure; wherein the container does not require special forming such as threads; wherein the closure can be applied readily without the formation of threads; wherein the closure and the container are more readily made and therefore lower in cost.

Among the further objectives of the invention are to provide a plastic closure for carbonated beverage containers which is of the snap-on type; which will withstand carbonation at three or four volumes; which utilizes an internal self-locking seal; which accommodates variations in pressure; which incorporates venting for safety purposes; which will withstand top loads; which includes a child and tamper resistant feature; which will accommodate manufacturing tolerances in the container; which is resealable; which is easy to open; which incorporates a double seal; and which utilizes less material and therefore is less expensive then prior closures for carbonated beverages.

In accordance with the invention, the carbonated beverage package comprises a container having an opening with a peripheral lip defining a free edge and a downwardly and outwardly inclined sealing surface spaced from the free edge of said peripheral lip and a closure of plastic material, such that it will flex in thin cross section, having an annular wall, a radial wall engaging the free edge of the peripheral lip of the container, and a transverse wall defining a convex surface facing inwardly of the container. The closure has a downwardly and outwardly inclined integral annular sealing surface at the juncture of the axial wall and transverse wall which engages the sealing surface of said container and places said axial wall under tension. The closure has a pressure relief rib at the juncture of the radial wall and axial wall such that axial force in the area overlying the rib will move a portion of the annular sealing surface of the closure away from the sealing surface of the container so that the pressure of the contents in the container can be relieved through a pressure relief opening through to the atmosphere and the closure can thereafter be readily removed from the container.

DESCRIPTION

Figure 1:
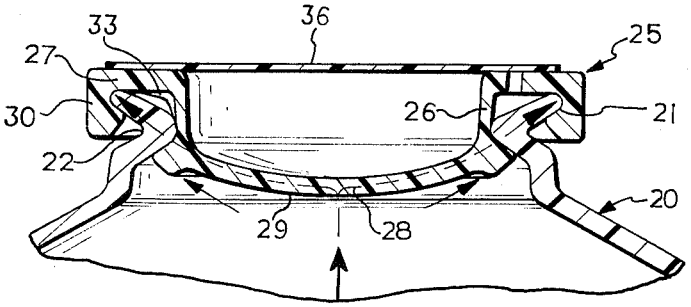
FIG. 1 is a vertical sectional view through a portion of a carbonated beverage package embodying the invention.

Referring to FIGS. 1-7, the carbonated beverage package embodying the invention comprises a container 20 that is made of plastic material suitable for holding carbonated beverages such as PET. The container 20 is made preferably by reheating the parison and blowing the parison in a mold at the proper conditions of temperature to form an oriented plastic container. As will be apparent, the closure need not necessarily be used with a carbonated beverage container made from parisons by the reheat and blow process but can be used on containers made by other conventional processes such as extrusion, blow molding or injection blow molding. The container may also be made of glass by known present day glass molding techniques.

The container 20 includes an opening defined by a peripheral annular flange or lip 21 that extends radially outward and axially outward. The container further includes an annular groove 22 that forms an internal annular sealing 23 that extends downwardly and outwardly.

The carbonated beverage package further includes a closure 25 made of a pliable plastic material which will bend in thin cross section, for purposes presently described, such as low or high density polyethylene, polypropylene or a combination thereof or blends of polyethylene, polypropylene and ethylene vinyl acetate (EVA) or blends thereof providing the desired flexibility and barrier properties.

The closure 25 includes an annular axial wall 26, a radial wall 27 and a transverse wall 28 that is curved and defines a convex surface 29 facing inwardly of the container. The closure 25 further includes a peripheral wall 30 with an inwardly facing annular bead 31 that engages below the free edge of the wall 21 to hold the closure 25 on the container 20.

The closure 25 has an annular sealing surface 32 that is defined by an annular rib 33 at the juncture of the axial wall 26 and transverse wall 28. The surface 32 extends downwardly and outwardly and engages the sealing surface 23 of the container 20 placing the axial wall 26 under tension.

Inasmuch as the wall 28 is convex inwardly of the container, pressure of the contents in the container is transmitted as shown by the broken lines in FIG. 1 along the transverse wall 28 toward the sealing surfaces 32, 23 and along the flange or lip 21 of the container 20 to the area of intersection of the radial wall 27 and peripheral wall 30 of the closure.

Figure 2:
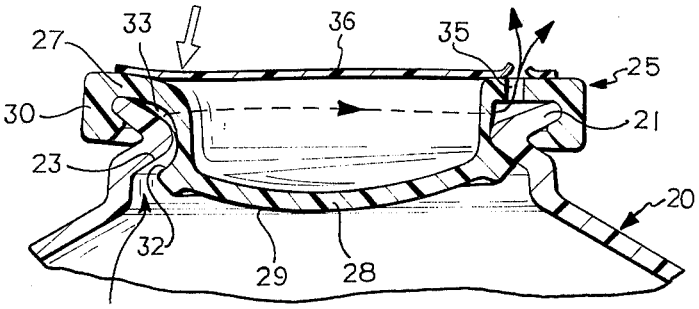
FIG. 2 is a view similar to FIG. 1 showing the functioning of the package for pressure relief.
Figure 3:
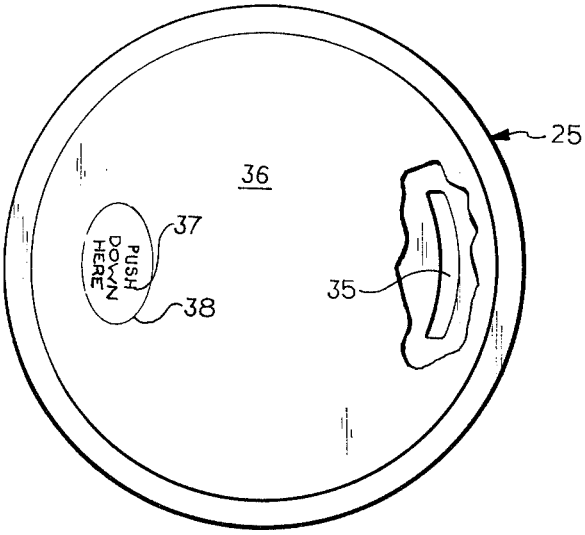
FIG. 3 is a plan view of the closure forming part of the carbonated beverage package.
Figure 4:
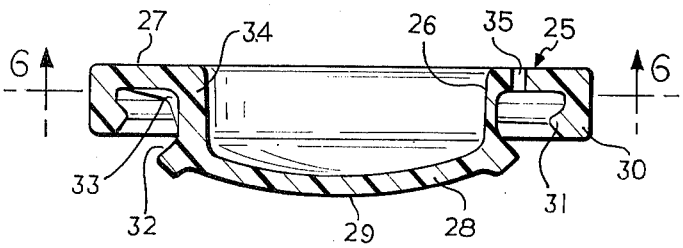
FIG. 4 is a sectional view taken along the line 4—4 in FIG. 5.
Figure 5:
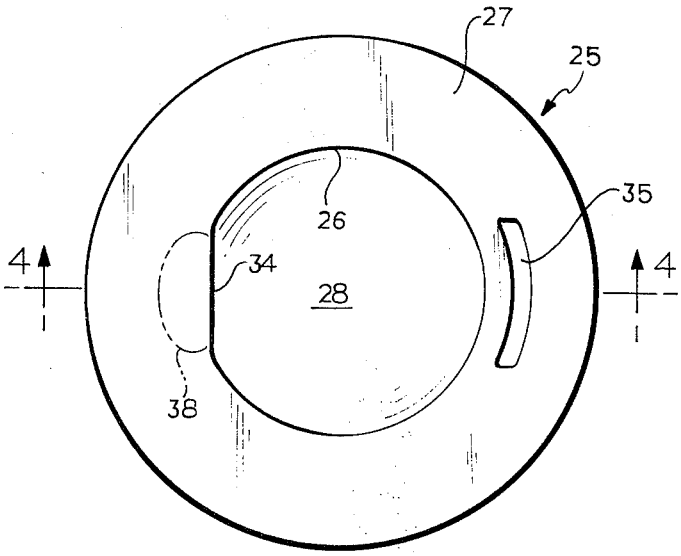
FIG. 5 is a plan view of the closure with the frangible cover removed.
Figure 6:
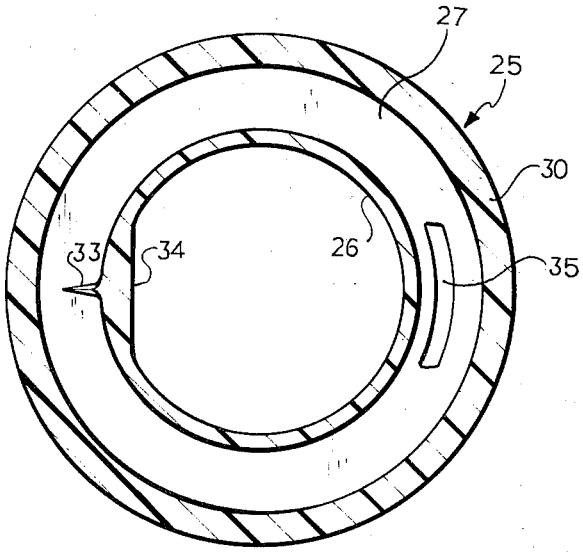
FIG. 6 is a sectional view taken along the line 6—6 in FIG. 4.
Figure 7:
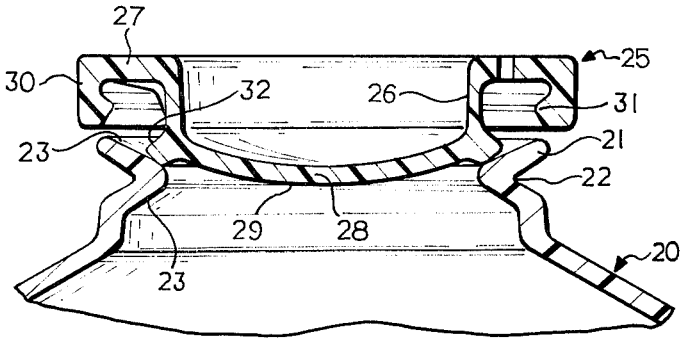
FIG. 7 is an exploded sectional view of the closure and a portion of the container.
Figure 16:
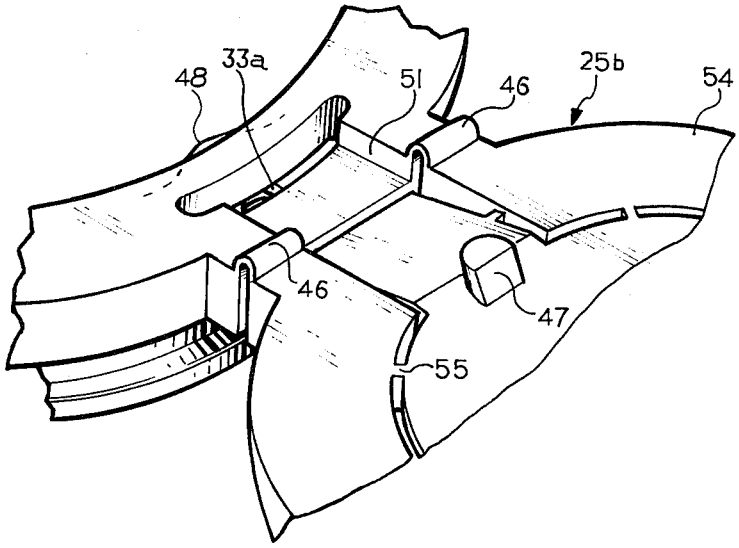
FIG. 16 is a fragmentary perspective view of a hinge portion of the closure.

The closure 25 further includes a pressure relief rib 33 (FIGS. 4, 6) on the outer surface of the radial wall and the axial wall and the axial wall includes a thickened portion 34 adjacent the rib to stiffen the wall in order that when an axial force is applied downwardly, in the direction of the arrow as viewed in FIG. 2, a portion of sealing surface 32 is moved away from the sealing surface 23 permitting the pressure of the contents to move into the space between the flange 21 and the radial wall 27 and pass outwardly through a pressure relief opening 35. A frangible cover 36 of paper or plastic is preferably adhered to wall 27. The pressure of the contents will burst a hole in the cover 36 at the area of the pressure relief opening 35 (FIG. 2). After the pressure has been dissipated, the cover 36 may be readily broken and the closure 25 removed by prying off the closure 25 at any place about its periphery. Indicia 37, 38 are provided on the cover 36 and closure 25 to indicate the point where the axial force should be applied (FIG. 3). The cover 36 which is broken upon pressure relief performs a tamper indicating function. The paper further covers the cavity which would otherwise tend to collect dirt and foreign matter. The cover 36 may also be made of a suitable material to improve the barrier properties across the wall 28. The air space between the cover 36 and wall 28 provides an additional barrier.

The use of a single rib 33 and reinforced wall 34 as shown in FIGS. 1-7 is preferred since it provides a child-resistant carbonated beverage package. By providing for breaking the seal between surfaces 32 and 33 only at a single predetermined position, any pressure on other circumferential positions would collapse the wall 26 without affecting the seal. The cover 36 forms a tamper indicating member.

Figure 19:
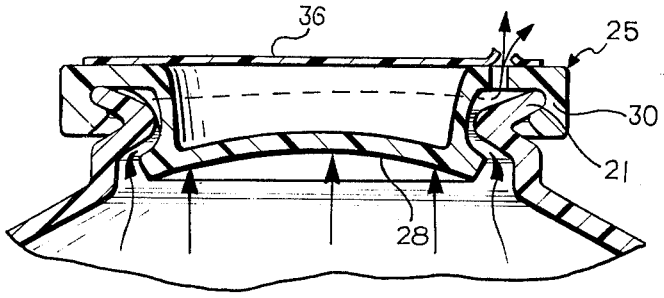
FIG. 19 is a fragmentary sectional view showing the manner in which the invention provides for self-venting.

As shown in FIG. 19, the closure embodying the invention further provides for venting of excessive pressure. If the pressure becomes excessive beyond a predetermined amount, the wall 28 will flex axially outwardly and revert permitting pressure to be relieved about the periphery of the closure 33. After the pressure is reduced to the predetermined level, the wall 28 will flex and snap back axially inwardly to its original position. As a result the closure will accommodate excessive internal pressure without being blown off the container.

Figure 8:
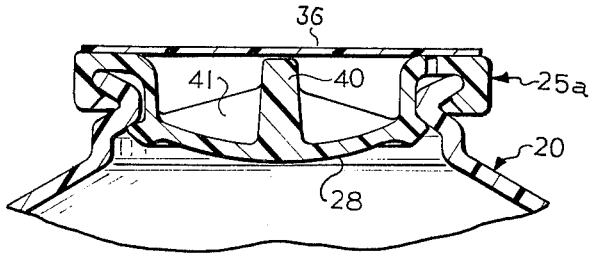
FIG. 8 is a fragmentary vertical sectional view of a modified form of carbonated beverage package.
Figure 9:
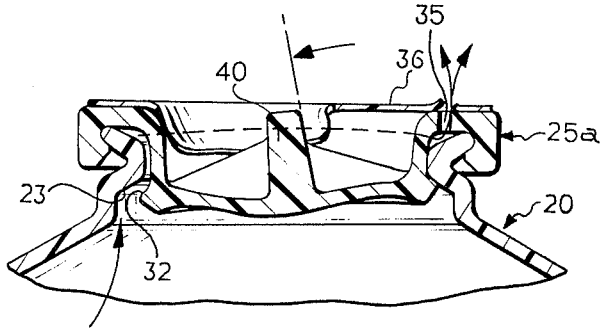
FIG. 9 is a view similar to FIG. 8 showing the functioning of the package during pressure relief.
Figure 10:
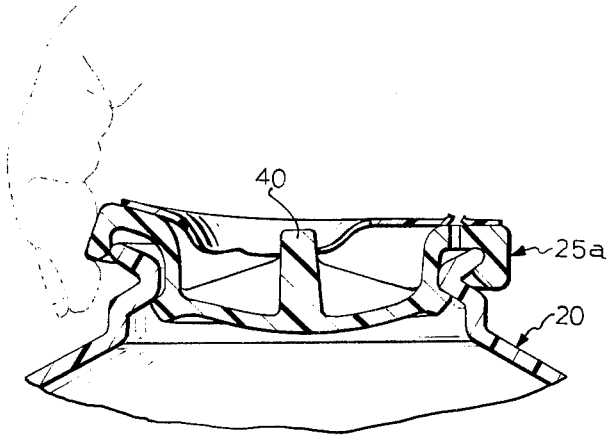
FIG. 10 is a view similar to FIG. 8 showing the manner in which the closure is removed.
Figure 11:
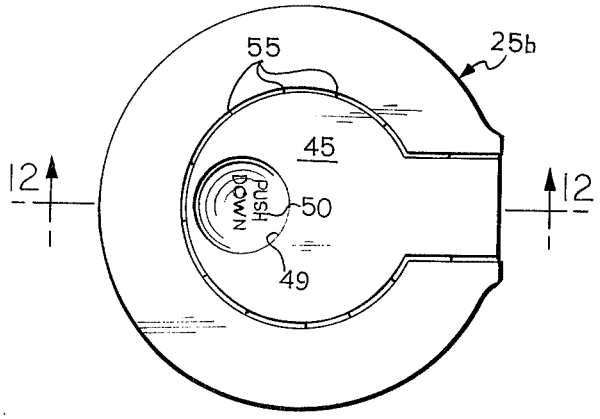
FIG. 11 is a plan view of another modified form of carbonated beverage package.

In the form of the invention shown in FIGS. 8, 9 and 10, closure 25*a* comprises an integral axial toggle lever 40 at the center of the transverse wall 28 and extending outwardly. Reinforcing ribs 41 extend from the lever to the area of juncture of the axial wall 26 and transverse wall 28.

In this form, the tamper indicating cover 36 is pierced and the lever 40 is then utilized in any direction to move a portion of the annular sealing surface 32 away from the sealing surface 23 of the container 20 to provide a pressure relief. The closure can then be pried off (FIG. 10).

Figure 12:
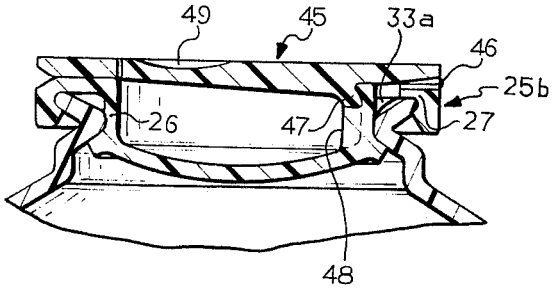
FIG. 12 is a fragmentary sectional view taken along the line 12—12 in FIG. 11.
Figure 13:
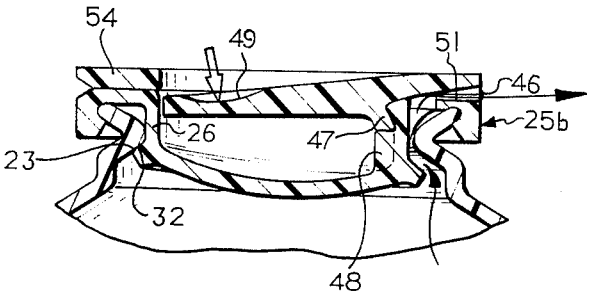
FIG. 13 is a view similar to FIG. 12 showing the functioning of the package for pressure relief.
Figure 14:
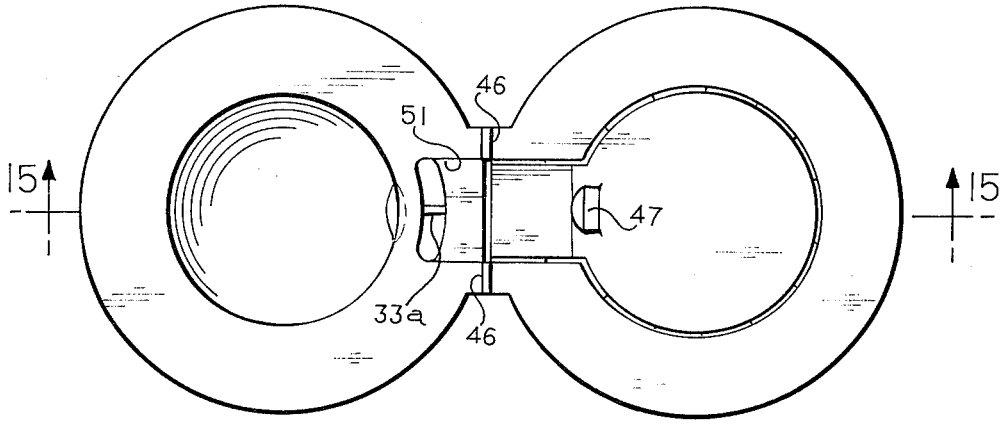
FIG. 14 is a top plan view of the closure shown in FIGS. 11 and 12 prior to being placed on the container.

In the form of the invention shown in FIGS. 11–18, closure 25*b* which is formed with an integral lever 45 is hinged as at 46 to the periphery of the radial wall 27 and an integral projection 47 on lever 45 is adapted to engage a thickened portion 48 on the axial wall 26 to apply the axial force for relieving the pressure of the contents of the container. The lever 45 normally overlies the closure 25*b*, as shown in FIG. 12, and has a finger recess 49 and indicia 50 indicating the place where axial force should be applied in order to relieve the pressure of the contents. The lever 45 acts as a force multiplier to facilitate the application of a downward force. The radial wall 27 is formed with a relief groove 51 and a portion of the lever 45 overlies this groove 51 to define a passage so that the contents will be directed radially outwardly when the pressure is relieved, as shown in FIG. 13.

Figure 15:
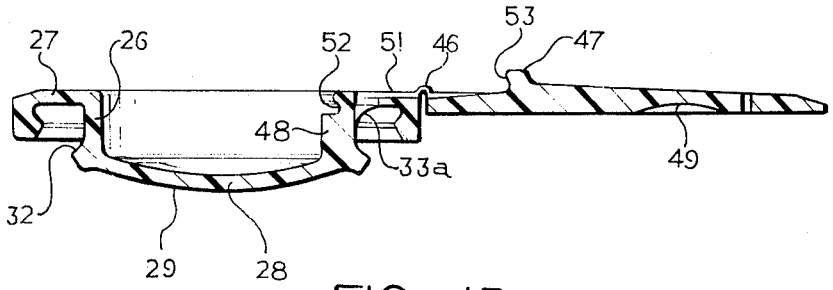
FIG. 15 is a sectional view taken along the line 15—15 in FIG. 14.
Figure 18:
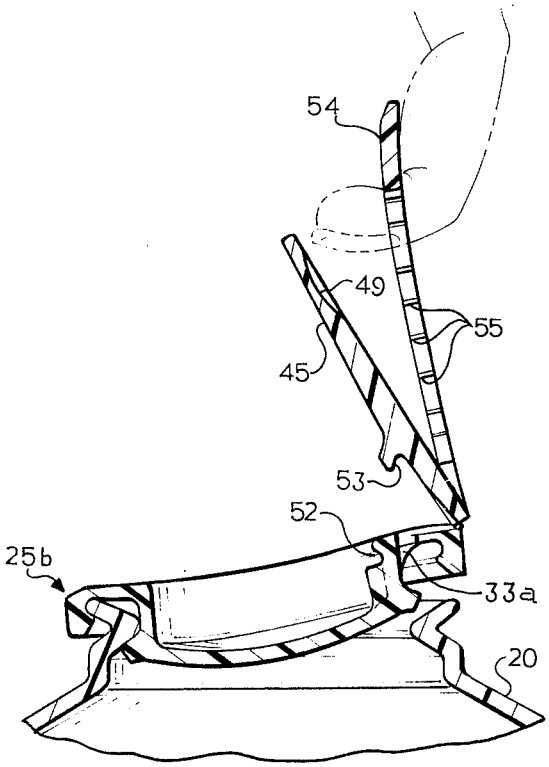
FIG. 18 is a view similar to FIG. 17 showing the final step in removal of the closure.

Interengaging means are provided between lever 45 and the remainder of the closure 25*b* to normally hold the lever 45 in position as shown in FIG. 12 and comprises an undercut 52 in the axial wall 26 which is engaged by a bead 53 on the lever (FIGS. 15 and 18).

Figure 17:
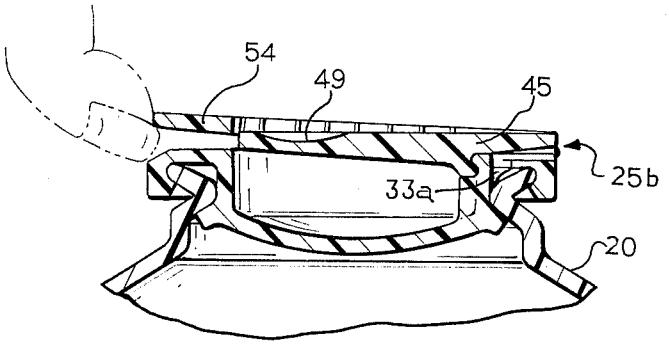
FIG. 17 is a view similar to FIG. 12 showing the initial step in removing the closure.

A lift ring 54 is integrally connected to the closure and particularly the lever 45 by weakened portions such as perforations 55. When the lever 46 is forced axially inwardly, the weakened portions 55 are broken. After the pressure is relieved, a finger can be utilized as shown in FIG. 17 to lift the lift ring 54 and then the finger can be inserted into the lift ring 54 as shown in FIG. 18, to remove the closure 25*b*.

Figure 20:
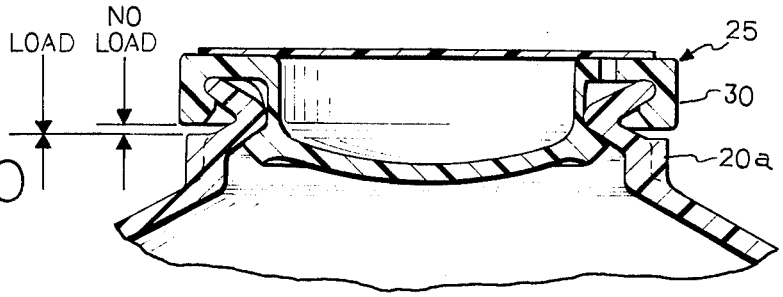
FIG. 20 is a fragmentary sectional view showing the manner in which the invention provides for top loading.

Referring to FIG. 20, each carbonated beverage package embodying the invention also functions to accommodate excessive top load. As shown, the peripheral wall 30 is spaced from the flange 21 of the container. Any excessive load will collapse the closure bringing the flange into engagement with the shoulder surface. In order to achieve and insure such a top load arrangement, the radial width of the shoulder 20*a* may be increased or alternatively portions of the shoulder are circumferentially extended in a radial direction about the container.

I clasim:

1. A carbonated beverage package comprising a container having an opening with a peripheral lip defining a free edge, said container having a downwardly and outwardly inclined sealing surface spaced from the free edge of said peripheral lip, a closure of plastic material such that it will flex in thin cross section, said closure having an annular wall, a radial wall engaging the free edge of the peripheral lip of the container and a transverse wall defining a convex surface facing inwardly of the container, interengaging means between said radial wall and said container, said closure having a downwardly and outwardly inclined integral annular sealing surface at the juncture of the axial wall and transverse wall, said sealing surface of said closure engaging said sealing surface of said container and placing said axial wall under tension, said closure having a pressure relief rib at the juncture of the radial wall and axial walls such that axial force in the area overlying said rib will move a portion of said annular sealing surface of said closure away from the sealing surface of said container, said closure having a pressure relief opening through which the pressure in the container can be relieved to the atmosphere such that the closure can thereafter be readily removed from the container.

2. The carbonated beverage package set forth in claim 1 including a thin cover adhered to said radial wall of said closure and overlying said pressure relief opening.

3. The carbonated beverage package set forth in claim 2 wherein said opening is in said radial wall.

4. The carbonated beverage package set forth in claim 1 including indicia on said cover indicating the area that must be pushed axially inwardly.

5. The carbonated beverage package set forth in claim 1 including a thickened portion adjacent said pressure relief rib.

6. The carbonated beverage package set forth in claim 1 including an integral toggle lever extending axially outwardly from the outer surface of the transverse wall for flexing said closure to move portions thereof away from the sealing surface of the container in order to obtain pressure relief.

7. The carbonated beverage package set forth in claim 6 including reinforcing ribs extending from said lever to the area of juncture of the axial wall and transverse wall.

8. The carbonated beverage package set forth in claim 1 wherein said closure includes a portion connected to the radial wall of the closure by an integral hinge, said portion having a projection adapted to engage a portion of the axial wall such that when a force is applied to the periphery of said lever, a portion of the sealing surface of the closure is moved away from the sealing surface of the container to provide pressure relief.

9. The carbonated beverage package set forth in claim 8 wherein said pressure relief opening comprises a radial groove in the outer surface of the radial wall, said lever when in position overlying said groove as to form a radially outwardly extending passageway from the relief of the pressure.

10. The carbonated beverage package set forth in claim 9 including interengaging means between said lever and said closure normally holding said lever in generally overlying relation to the closure.

11. The carbonated beverage package set forth in claim 10 wherein said interengaging means comprises a radially inwardly extending bead on said axial wall of the closure, said projection on said lever having an undercut portion engaged by said bead.

12. The carbonated beverage package set forth in claim 11 wherein said closure includes a generally circular integral lift tab surrounding said lever and integrally connected to the remainder of the closure such that after the pressure has been relieved, the lift tab can be pulled away from its position adjacent the radial wall of the closure and a finger can be inserted to lift the closure from the container.

13. The carbonated beverage package set forth in claim 12 including weakened means interconnecting the lever and the lift ring such that when a force is applied to the lever to relieve the pressure, the connection between the lever and the ring is broken along the weakened lines.

14. The carbonated beverage package set forth in claim 13 wherein said lever includes a finger receiving recess at the area where force should be applied on the lever.

15. The carbonated beverage package set forth in claim 14 including indicia on said lever indicating the area where the force should be applied on said lever.

16. The carbonated beverage package set forth in claim 1 wherein said interengaging means comprises a peripheral wall on said closure, an annular peripheral groove on said container and means on said peripheral wall engaging said groove.

17. The carbonated beverage package set forth in claim 16 wherein said last mentioned means comprises an annular bead on the peripheral wall of said closure.

18. The carbonated beverage package set forth in claim 1 wherein said container includes a radial shoulder adapted to be engaged by the annular wall of the closure upon application of a top load to the closure and container.

19. A closure for a carbonated beverage package comprising said closure being made of plastic material such that it will flex in thin cross section, said closure having an annular wall, a radial wall engaging the free edge of the peripheral lip of the container, and a transverse wall defining a convex surface facing inwardly of the container, means on said closure for engaging a container to hold the closure on a container, said closure having a downwardly and outwardly inclined integral annular sealing surface at the juncture of the axial wall and transverse wall, said sealing surface of said closure adapted to engage a complementary sealing surface on a container and place said axial wall under tension, said closure having a pressure relief rib at the juncture of the radial wall and axial walls such that axial force in the area overlying said rib will move a portion of said annular sealing surface of said closure away from the sealing surface of the container, said closure having a pressure relief opening through which the pressure in the container can be relieved to the atmosphere such that the closure can thereafter be readily removed from the container.

20. The closure for a carbonated beverage package set forth in claim 19 including a cover of frangible material adhered to said radial wall of said closure and overlying said pressure relief opening.

21. The closure for a carbonated beverage package set forth in claim 20 wherein said opening is in said radial wall.

22. The closure for a carbonated beverage package set forth in claim 21 including indicia on said cover indicating the area that must be pushed axially inwardly.

23. The closure for a carbonated beverage package set forth in claim 19 including a thickened portion adjacent said pressure relief rib.

24. The closure for a carbonated beverage package set forth in claim 19 including an integral toggle lever extending axially outwardly from the outer surface of the transverse wall for flexing said closure to move portions thereof away from a sealing surface of a container in order to obtain pressure relief.

25. The closure for a carbonated beverage package set forth in claim 24 including reinforcing ribs extending from said lever to the area of juncture of the axial wall and transverse wall.

26. The closure for a carbonated beverage package set forth in claim 25 wherein said closure includes a portion connected to the radial wall of the closure by an integral hinge, said portion having a projection adapted to engage a portion of the axial wall such that when a force is applied to the periphery of said lever, a portion of the sealing surface of the closure is moved away from the sealing surface of the container to provide pressure relief.

27. The closure for a carbonated beverage package set forth in claim 26 wherein said pressure relief opening comprises a radial groove in the outer surface of the radial wall, said lever when in position overlying said groove as to form a radially outwardly extending passageway for the relief of the pressure.

28. The closure for a carbonated beverage package set forth in claim 26 including interengaging means between said lever and said closure normally holding said lever in generally overlying relation to the closure.

29. The closure for a carbonated beverage package set forth in claim 28 wherein said interengaging means comprises a radially inwardly extending bead on said axial wall of the closure, said projection on said lever having an undercut portion engaged by said bead.

30. The closure for a carbonated beverage package set forth in claim 29 wherein said closure includes a generally circular integral lift tab surrounding said lever and integrally connected to the remainder of the closure such that after the pressure has been relieved, the lift tab can be pulled away from its position adjacent the radial wall of the closure and a finger can be inserted to lift the closure from the container.

31. The closure for a carbonated beverage package set forth in claim 30 including weakened means interconnecting the lever and the lift ring such that when a force is applied to the lever to relieve the pressure, the connection between the lever and the ring is broken along the weakened lines.

32. The closure for a carbonated beverage package set forth in claim 31 wherein said lever includes a finger receiving recess at the area where pressure should be applied on the lever.

33. The closure for a carbonated beverage package set forth in claim 32 including indicia on said lever indicating the area where the force should be applied on said lever.

34. The closure for a carbonated beverage package set forth in claim 19 wherein said interengaging means comprises an annular bead on said annular wall adapted to engage a groove on a container.

35. The closure for a carbonated beverage package set forth in claim 34 wherein said last-mentioned means comprises an annular bead on the peripheral wall of said closure.

* * * * *